US008752729B2

(12) United States Patent
Maccario

(10) Patent No.: US 8,752,729 B2
(45) Date of Patent: Jun. 17, 2014

(54) COMBINATION DISPENSING AND DISPOSAL CONTAINER

(76) Inventor: Susan C. Maccario, Naples, FL (US)

( * ) Notice: Subject to any disclaimer, the term of this patent is extended or adjusted under 35 U.S.C. 154(b) by 874 days.

(21) Appl. No.: 12/576,653

(22) Filed: Oct. 9, 2009

(65) Prior Publication Data

US 2011/0084089 A1 Apr. 14, 2011

(51) Int. Cl.
*A47K 10/46* (2006.01)
*A47K 10/42* (2006.01)

(52) U.S. Cl.
USPC ..... 221/34; 221/33; 221/63; 221/102; 221/133; 221/45; 221/48; 221/309; 221/38; 221/134; 206/233; 206/494; 206/449; 248/340; 222/180

(58) Field of Classification Search
CPC ..... A47K 10/46; A47K 10/42; B65D 17/02
USPC ..... 221/33, 34, 63, 102, 133, 45, 48, 309, 221/38, 134; 242/598.5, 55.53; 222/180; 206/233, 494, 449; 248/340
See application file for complete search history.

(56) References Cited

U.S. PATENT DOCUMENTS

| | | | | | |
|---|---|---|---|---|---|
| 1,988,939 | A | | 1/1935 | Craig | |
| 2,415,588 | A | | 2/1947 | Gui | |
| 2,915,218 | A | | 12/1959 | Rosenman at al. | |
| 3,001,645 | A | * | 9/1961 | Hernberg | 206/449 |
| 3,095,087 | A | * | 6/1963 | Yates | 206/449 |
| 3,221,928 | A | * | 12/1965 | Horn | 221/34 |
| 3,331,498 | A | * | 7/1967 | Davies | 206/494 |
| D232,932 | S | * | 9/1974 | Stahel, II | D19/75 |
| 4,879,442 | A | * | 11/1989 | Giovine | 206/233 |
| 4,919,302 | A | * | 4/1990 | McPherson | 221/34 |
| 5,054,612 | A | * | 10/1991 | Meyer, Jr. | 206/233 |
| 5,129,545 | A | * | 7/1992 | Parks | 221/34 |
| 5,944,219 | A | * | 8/1999 | Emoff et al. | 221/45 |
| 6,321,937 | B1 | * | 11/2001 | DeSimone et al. | 221/45 |
| 6,371,296 | B1 | * | 4/2002 | Rumbough | 206/494 |
| 6,427,839 | B1 | * | 8/2002 | Helfer-Grand | 206/494 |
| 6,439,386 | B1 | * | 8/2002 | Sauer et al. | 206/494 |
| 6,648,172 | B2 | * | 11/2003 | Leighton et al. | 221/35 |
| 6,672,474 | B2 | * | 1/2004 | May et al. | 221/34 |
| 6,675,986 | B1 | * | 1/2004 | Spencer | 221/98 |

(Continued)

FOREIGN PATENT DOCUMENTS

DE 10061670 6/2002

*Primary Examiner* — Gene O. Crawford
*Assistant Examiner* — Rakesh Kumar
(74) *Attorney, Agent, or Firm* — The Livingston Firm; Edward M. Livingston, Esq.; Bryan L. Loeffler, Esq.

(57) ABSTRACT

The present invention fulfills the above and other objects by providing a combination dispensing and disposal container (1) having a dispensing end (2) with a dispensing opening (3) for dispensing new items, such as facial tissue, wet wipes, candy, etc. On the opposite end of the container is a disposal end (4) with a disposal opening (5) for accepting trash. A bladder (6) located inside of the container separates a storage compartment (7) where new items are held from a disposal compartment (8) where trash is held. In addition to or in lieu of a bladder, a rigid partition (9) may also separate the storage compartment from the disposal compartment. One or more lids (10, 11) keeps the dispensing and end and the disposal end sealed when not in use. An additional feature is a strap (12) that allows a user to attach the tissue container to his or her wrist.

3 Claims, 3 Drawing Sheets

(56) References Cited

U.S. PATENT DOCUMENTS

| | | | | |
|---|---|---|---|---|
| 6,702,147 | B2 * | 3/2004 | Ashford | 221/34 |
| 6,863,192 | B2 | 3/2005 | Tumlinson | |
| 7,073,684 | B2 | 7/2006 | Decker et al. | |
| 7,357,274 | B2 * | 4/2008 | Hewett | 221/35 |
| 7,380,687 | B2 * | 6/2008 | FitzSimons et al. | 221/45 |
| 7,490,734 | B2 * | 2/2009 | Carr | 221/102 |
| 2002/0121451 | A1 | 9/2002 | Subramanian et al. | |
| 2003/0178336 | A1 * | 9/2003 | Zomorodi et al. | 206/494 |
| 2003/0178436 | A1 * | 9/2003 | Ashford | 221/33 |
| 2003/0189059 | A1 * | 10/2003 | May et al. | 221/34 |
| 2006/0101564 | A1 * | 5/2006 | Powdermaker | 4/259 |
| 2007/0062966 | A1 | 3/2007 | Mark et al. | |
| 2007/0272694 | A1 * | 11/2007 | May et al. | 220/495.07 |
| 2008/0169304 | A1 | 7/2008 | Fino et al. | |
| 2010/0126998 | A1 * | 5/2010 | Wilson et al. | 220/495.07 |

* cited by examiner

COMBINATION DISPENSING AND DISPOSAL CONTAINER

BACKGROUND OF THE INVENTION

This invention relates to containers, more particularly, a container having multiple compartments, which are separated by a bladder and/or a partition, for holding and dispensing of new items, such as tissues, moist towelettes, wrapped candy, and disposing of trash, such as used tissues, used moist towelettes, candy wrappers ans so forth.

Most containers for items, such as tissues, moist towelettes, wrapped candy, etc., are commonly cardboard boxes having an opening on the top for dispensing the items that are contained therein. A problem with current containers is that they do not provide a means for disposing of trash, such as used tissues, used moist towelettes, candy wrappers, etc. This poses a problem especially in places where a thrash can is not easily accessible, such as in a car, airplane, movie theater, classroom, etc. Furthermore, this especially poses a problem with personal hygiene items, such as tissues and wet wipes, because the germs, bacteria and/or viruses contained in used personal hygiene items can pose a health risk to others if the these items are not disposed of properly.

Therefore, a need exists for a container having multiple compartments, which are separated by a bladder and/or a partition, for holding new items, such as tissues, moist towelettes, wrapped candy, etc., and disposing of trash, such as used tissues, used moist towelettes, candy wrappers, etc.

The relevant prior art includes the following references:

| Patent No. (U.S. unless stated otherwise) | Inventor | Issue/Publication Date |
|---|---|---|
| 2008/0169304 | Fino et al. | Jul. 17, 2008 |
| 2007/0062966 | Mark et al. | Mar. 22, 2007 |
| 7,073,684 | Decker et al. | Jul. 11, 2006 |
| 6,863,192 | Tumlinson | Mar. 08, 2005 |
| 6,675,986 | Spencer | Jan. 13, 2004 |
| 6,672,474 | May et al. | Jan. 06, 2004 |
| 2002/0121451 | Subramanian et al. | Sep. 05, 2002 |
| DE10061670 | Braun | Jun. 13, 2002 |
| 5,129,545 | Parks | Jul. 14, 1992 |
| 4,919,302 | McPherson | Apr. 24, 1990 |
| 3,331,498 | Davies | Jul. 18, 1967 |
| 3,221,928 | Horn | Dec. 07, 1965 |
| 3,095,087 | Yates | Jun. 25, 1963 |
| 3,001,645 | Hernberg | Sep. 26, 1961 |
| 2,915,218 | Rosenman, et al. | Dec. 01, 1959 |
| 2,415,588 | Gui | Feb. 11, 1947 |
| 1,988,939 | Craig | Jan. 22, 1935 |

SUMMARY OF THE INVENTION

The primary object of the present invention is to provide a combination dispensing and disposal container that stores both new and used items.

Another object of the present invention is to provide a combination dispensing and disposal container that prevents the spread of germs, bacteria and/or viruses contained in used personal hygiene items.

An even further object of the present invention is to provide a combination dispensing and disposal container that is easy to carry.

Another object of the present invention is to provide a combination dispensing and disposal container that will fit into a cup holder.

An even further object of the present invention is to provide a combination dispensing and disposal container that can be personalized in order to easily identify the owner of the combination dispensing and disposal container.

The present invention fulfills the above and other objects by providing a combination dispensing and disposal container that is preferably substantially tubular in shape so that it will fit into a cup holder in an automobile, theater seat, etc. On one end of the combination dispensing and disposal container is a dispensing end having an opening for dispensing new items, such as facial tissue, wet wipes, candy, etc. On the opposite end of the combination dispensing and disposal container is a disposal end having, an opening for accepting trash, such as used tissues, used moist towelettes, candy wrappers, etc. A plastic bladder located inside of the container separates a storage compartment, where the new items are held, from a disposal compartment, where trash is held. Alternatively, a rigid partition may be used to separate the storage compartment from the disposal compartment. The rigid partition ensures that the items stored in the storage compartment rise evenly towards the dispensing end of the container when used items and/or trash are placed in the disposal compartment. The dispensing end of the combination dispensing and disposal container may be recessed so that when the dispensing end is placed on a table there is a space separating the dispensing end from the surface of the table, thereby reducing the chance of germs being spread onto the surface of the table. One or more lids are provided to keep the dispensing end and the disposal end sealed when not in use. An additional feature is an adjustable strap or band that allows a user to attach the combination dispensing and disposal container to his or her wrist.

The combination dispensing and disposal container may be used with a variety of items. For example, new tissues may be stored in the storage compartment and used tissue may be place in the disposal compartment. Alternatively, items such as wrapped candies may be stored in the storage compartment and the wrappers from the candies may be placed in the disposal compartment.

The above and other objects, features and advantages of the present invention should become even more readily apparent to those skilled in the art upon a reading of the following detailed description in conjunction with the drawings wherein there is shown and described illustrative embodiments of the invention.

BRIEF DESCRIPTION OF THE DRAWINGS

In the following detailed description, reference will be made to the attached drawings in which.

DESCRIPTION OF THE PREFERRED EMBODIMENTS

Figure 1:
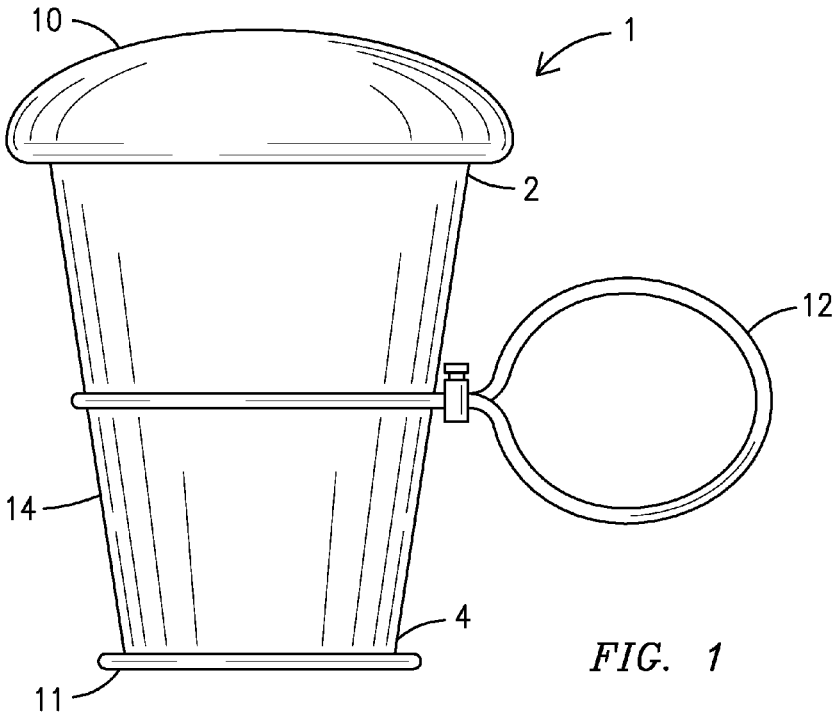
FIG. 1 is a side view of a combination dispensing and disposal container of the present invention having a strap attached thereto.
Figure 2:
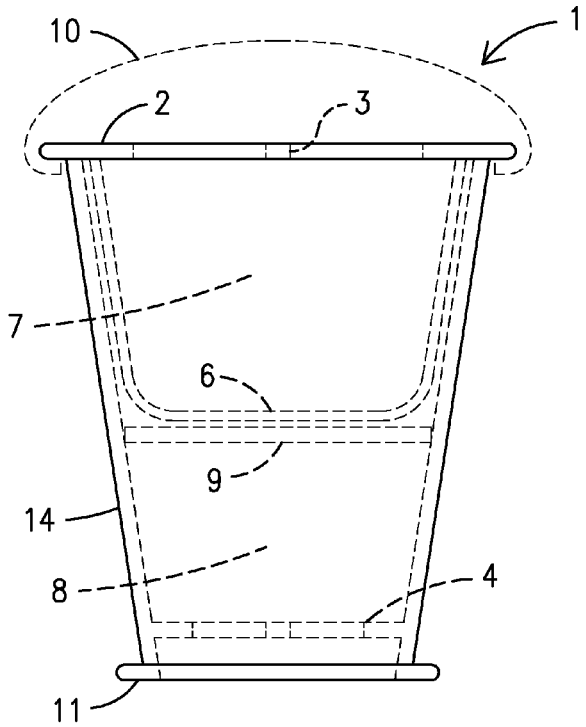
FIG. 2 is a plan side view of a combination dispensing and disposal container of the present invention.

For purposes of describing the preferred embodiment, the terminology used in reference to the numbered accessories in the drawings is as follows:

1. container
2. dispensing end
3. dispensing opening
4. disposal end
5. disposal opening
6. bladder
7. storage compartment
8. disposal compartment
9. partition
10. first lid
11. second lid
12. strap
13. identification means
14. perimeter wall With reference to FIG. 1, a side view of a combination dispensing and disposal container 1 of the present invention is shown. The combination dispensing and disposal container 1 has at least one perimeter wall 14. Although the combination dispensing and disposal container 1 may have different shapes, it is preferably substantially tubular in shape so that the combination dispensing and disposal container 1 will fit into a cup holder in an automobile, theater seat, etc. On a dispensing end 2 of the combination dispensing and disposal container 1 is an dispensing opening 3 for dispensing new items, such as facial tissue, wet wipes, candy, etc, which is shown further in FIG. 3. On a disposal end 4 of the combination dispensing and disposal container 1 is a disposal opening 5 for accepting trash, such as used tissues, used moist towelettes, candy wrappers, etc., which is shown further in FIG. 4. A first lid 10 and a second lid 11 keep the dispensing end 2 and the disposal end 4 sealed when not in use. The second lid 11 is may be slightly smaller that the first lid 10 so that the first lid 10 will fit over the second lid 11 when the first lid 10 is not in use. An additional feature is a strap 12 that allows a user to attach the combination dispensing and disposal container 1 to his or her wrist or objects, such as chair arms, bicycle handle bars, walkers, wheel chair arms, etc., for easy and quick access With reference to FIG. 2, a plan side view of a combination dispensing and disposal container 1 of the present invention is shown. The combination dispensing and disposal container 1 has at least one perimeter wall 14, which is preferably substantially tubular in shape so that the combination dispensing and disposal container 1 will fit into a cup holder in an automobile, theater seat, etc. On a dispensing end 2 of the combination dispensing and disposal container 1 is a dispensing opening 3 for dispensing new items, such as facial tissue, wet wipes, candy, etc, which is shown further in FIG. 3. On a disposal end 4 of the combination dispensing and disposal container 1 is a disposal opening 5 for accepting trash, such as used tissues, used moist towelettes, candy wrappers, etc., which is shown further in FIG. 4. A bladder 6 located inside of the combination dispensing and disposal container 1 separates a storage compartment 7 where new items are held from a disposal compartment 8 where used items and trash may be placed and stored. A partition 9, preferably made of a rigid material and slidable along inside the perimeter wall 14 may also be employed in addition to or in lieu of a bladder 6 to separate the storage compartment 7 from the disposal compartment 8. The partition 9 ensures that the items stored in the storage compartment 7 rise evenly towards the dispensing end 2 of the combination dispensing and disposal container 1 when used items and/or trash is placed in the disposal compartment 8. The disposal end 4 of the combination dispensing and disposal container 1 may be recessed so that when the disposal end 4 is placed on a table or other surface there is a space separating the disposal opening 5 from the table or other surface, thereby reducing the chance of germs being spread onto the table or other surface. A first lid 10 and a second lid 11 keep the dispensing end 2 and the disposal end 4 sealed when not in use.

Figure 3:
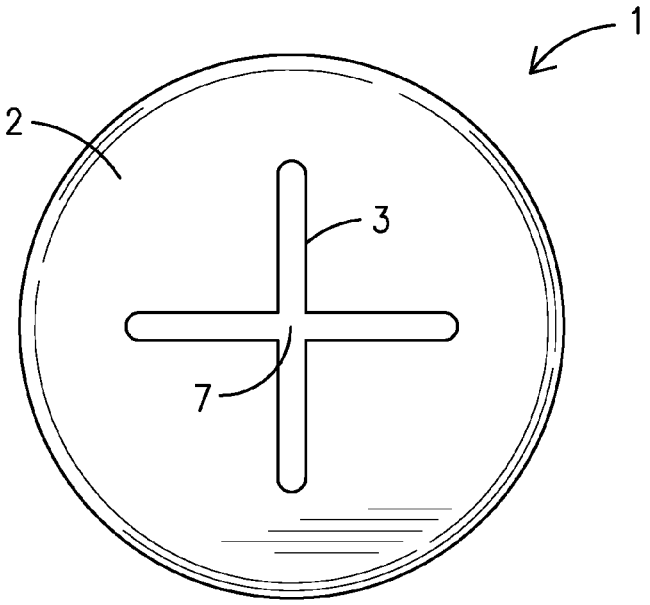
FIG. 3 is a top view of a dispensing end of a combination dispensing and disposal container of the present invention.

Now referring to FIG. 3, a top view of a dispensing end 2 of a combination dispensing and disposal container 1 of the present invention is shown. On the dispensing end 2 of the combination dispensing and disposal container 1 is a dispensing opening 3 for dispensing new items, such as facial tissue, wet wipes, candy, etc., that are stored in the storage compartment 7.

Figure 4:
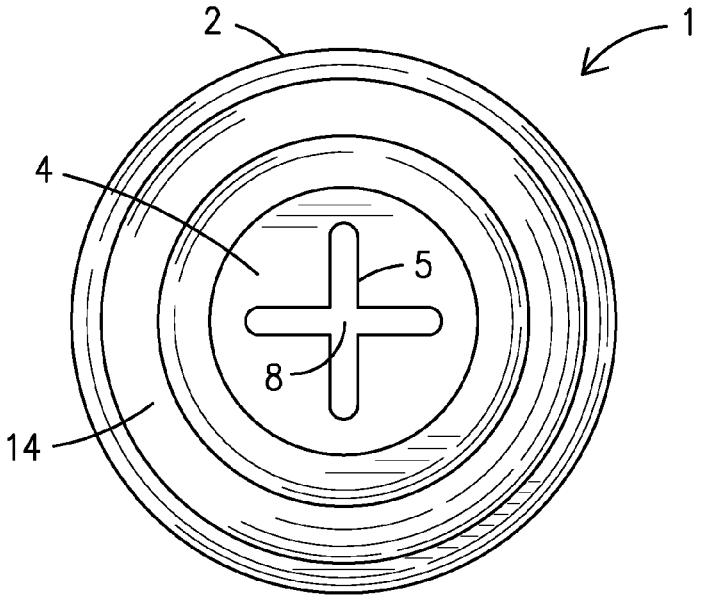
FIG. 4 is a top view of a disposal end of a combination dispensing and disposal container of the present invention.

Now referring to FIG. 4, a top view of a disposal end 4 of a combination dispensing and disposal container 1 of the present invention is shown. On the disposal end 4 of the combination dispensing and disposal container 1 is a disposal opening 5 for placing used items, such as facial tissue, wet wipes, candy wrappers, etc., into the disposal compartment 8.

Figure 5:
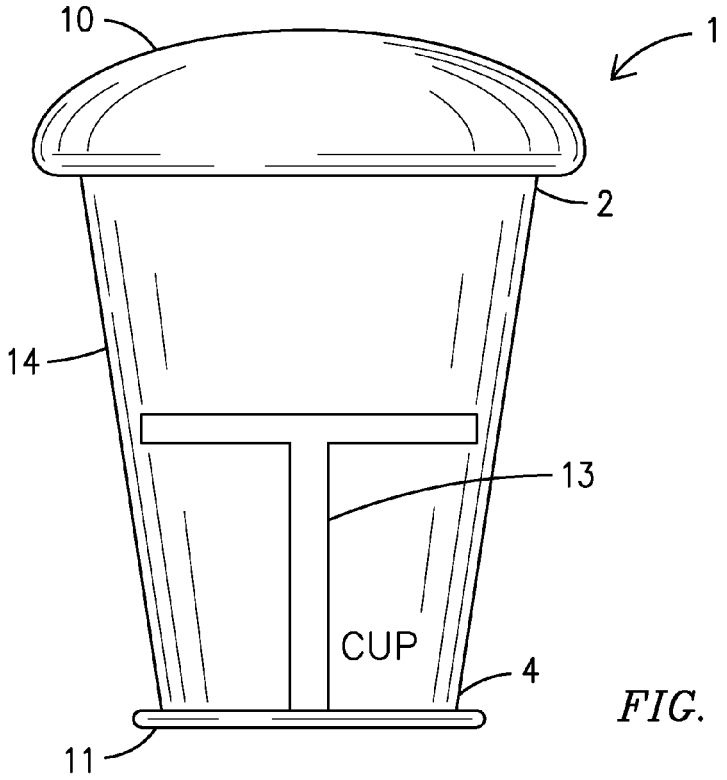
FIG. 5 a side view of a combination dispensing and disposal container of the present invention having an identification means.

With reference to FIG. 5, a side view of a combination dispensing and disposal container 1 of the present invention having an identification means 13 is shown. The combination dispensing and disposal container 1 has at least one perimeter wall 14, which is preferably substantially tubular in shape so that the combination dispensing and disposal container 1 will fit into a cup holder in an automobile, theater seat, etc. On a dispensing end 2 of the combination dispensing and disposal container 1 is an dispensing opening 3 for dispensing new items, such as facial tissue, wet wipes, candy, etc, which is shown further in FIG. 3. On a disposal end 4 of the combination dispensing and disposal container 1 is a disposal opening 5 for accepting trash, such as used tissues, used moist towelettes, candy wrappers, etc., which is shown further in FIG. 4. A first lid 10 and a second lid 11 keep the dispensing end 2 and the disposal end 4 sealed when not in use. An additional feature is an identification means 13 that provides an area for a user to write his or her name on the combination dispensing and disposal container 1 so that the combination dispensing and disposal container 1 is easily identifiable, thereby preventing multiple combination dispensing and disposal containers 1 from being mixed up in situations where multiple combination dispensing and disposal containers 1 are being used, such as in classrooms.

Figure 6:
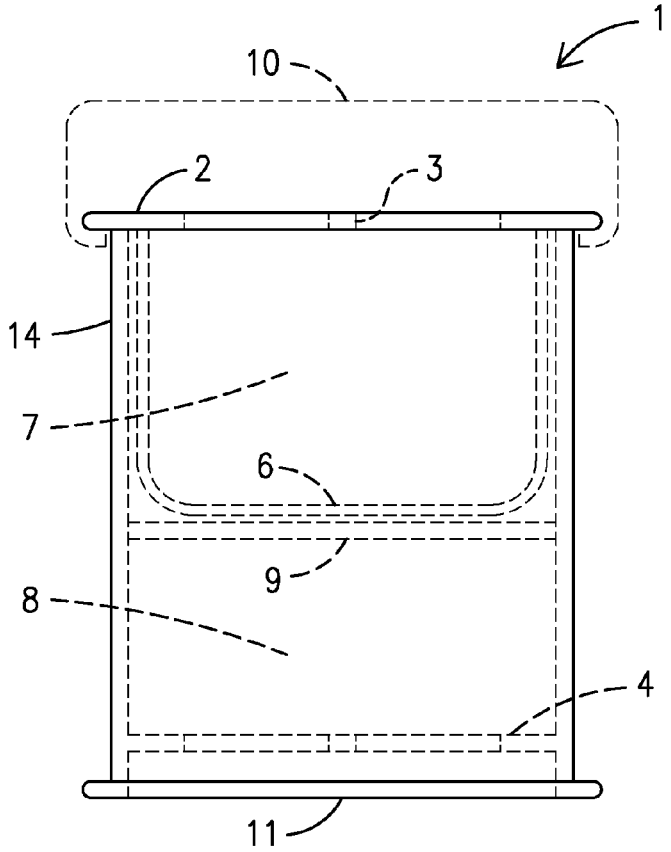
FIG. 6 a plan side view of a substantially rectangular shaped combination dispensing and disposal container of the present invention.

Finally, with reference to FIG. 6, a plan side view of a substantially rectangular shaped combination dispensing and disposal container 1 of the present invention is shown. The combination dispensing and disposal container 1 has at least one perimeter wall 14. On a dispensing end 2 of the combination dispensing and disposal container 1 is an dispensing opening 3 for dispensing new items, such as facial tissue, wet wipes, candy, etc, which is shown further in FIG. 3. On a disposal end 4 of the combination dispensing and disposal container 1 is a disposal opening 5 for accepting trash, such as used tissues, used moist towelettes, candy wrappers, etc., which is shown further in FIG. 4. A first lid 10 and a second lid 11 keep the dispensing end 2 and the disposal end 4 sealed when not in use.

It is to be understood that while a preferred embodiment of the invention is illustrated, it is not to be limited to the specific form or arrangement of parts herein described and shown. It will be apparent to those skilled in the art that various changes may be made without departing from the scope of the invention and the invention is not to be considered limited to what is shown and described in the specification and drawings.

Having thus described my invention, I claim:

1. A combination dispensing and disposal container comprising:

a cylindrical perimeter wall forming a perimeter of the container;

a dispensing end attached to the cylindrical perimeter wall;

a dispensing opening located on said dispensing end;

a disposal end attached to the cylindrical perimeter wall;

said disposal end being perpendicular to the at least one cylindrical perimeter wall;

a disposal opening located on said disposal end;

a storage compartment located inside the container on the dispensing end for storing unused items;

a disposal compartment located inside the container on the disposal end for storing used items; and a collapsible bladder secured within the storage compartment and defining an enclosed compartment for storing items;

a separate movable partition located inside the container below the bladder and above the disposal compartment for separating the storage compartment from the disposal compartment;

said partition being located perpendicular to said cylindrical perimeter wall and being unattached to the cylindrical perimeter wall, thereby being free-floating and slideable within the cylindrical perimeter wall;

said partition being located in an inferior position to the bladder so that as used items are inserted into the disposal compartment, the used items press upward against the partition, thereby sliding the partition upward against the bladder and the unused items raising the unused items within the container toward the dispensing end;

said disposal end having a diameter that is less than the diameter of the dispensing end so a user can easily determine which is the dispensing end and which is the disposal end so the cylindrical perimeter wall angles downward and from the dispensing end to the disposal end; and said partition having a diameter that prevents it from sliding downward into the disposal compartment.

2. The combination dispensing and disposal container of claim 1 wherein:

said disposal opening and disposal end being recessed within said cylindrical perimeter wall.

3. The combination dispensing and disposal container of claim 1 further comprising:

a looped strap attached to said cylindrical perimeter wall.

* * * * *